US012006610B2

(12) United States Patent
Yoon et al.

(10) Patent No.: US 12,006,610 B2
(45) Date of Patent: Jun. 11, 2024

(54) AUTOMATIC DRYING CYCLE AFTER EXECUTION OF SELF CLEAN CYCLE IN A LAUNDRY APPLIANCE

(71) Applicant: Haier US Appliance Solutions, Inc., Wilmington, DE (US)

(72) Inventors: Je Kwon Yoon, Seongnam (KR); Seonghoon Ryu, Seoul (KR); Wonmyung Seo, Gyeonggi-do (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 53 days.

(21) Appl. No.: 17/591,048

(22) Filed: Feb. 2, 2022

(65) Prior Publication Data

US 2023/0243079 A1 Aug. 3, 2023

(51) Int. Cl.

| | |
|---|---|
| ***D06F 33/43*** | (2020.01) |
| ***D06F 23/02*** | (2006.01) |
| ***D06F 34/28*** | (2020.01) |
| ***D06F 39/06*** | (2006.01) |
| *D06F 103/34* | (2020.01) |
| *D06F 105/30* | (2020.01) |
| *D06F 105/32* | (2020.01) |

(52) U.S. Cl.

CPC ..... *D06F 33/43* (2020.02); *D06F 23/02* (2013.01); *D06F 34/28* (2020.02); *D06F 39/06* (2013.01); *D06F 2103/34* (2020.02); *D06F 2105/30* (2020.02); *D06F 2105/32* (2020.02)

(58) Field of Classification Search

CPC ..... D06F 33/43; D06F 23/02; D06F 34/28; D06F 39/06; D06F 2103/34; D06F 2105/30; D06F 2105/32; D06F 25/00; D06F 34/05; D06F 58/20; D06F 58/24; D06F 58/38

See application file for complete search history.

(56) References Cited

U.S. PATENT DOCUMENTS

| | | | | |
|---|---|---|---|---|
| 11,085,137 | B2 | 8/2021 | Salvi et al. | |
| 2013/0139556 | A1* | 6/2013 | Eglmeier | D06F 37/42 68/13 R |
| 2019/0292705 | A1* | 9/2019 | Boutiette | D06F 58/38 |

FOREIGN PATENT DOCUMENTS

| | | | |
|---|---|---|---|
| CN | 112575524 | A | 3/2021 |
| CN | 113969486 | A * | 1/2022 |
| KR | 20050041504 | A | 5/2005 |
| KR | 101082886 | B1 | 11/2011 |

* cited by examiner

*Primary Examiner* — Joseph L. Perrin
(74) *Attorney, Agent, or Firm* — Dority & Manning, P.A.

(57) ABSTRACT

A laundry appliance includes a drum rotatably mounted within a cabinet and defining a chamber configured for receiving a load of clothes, a door pivotally mounted to the cabinet for providing selective access to the chamber, and a user interface for controlling operation of the laundry appliance. A controller is configured to initiate a self-clean cycle and to automatically commence a drying cycle at the conclusion of the self-clean cycle. The drying cycle is based on operation data associated with the drying cycle, such as a predetermined period of time to complete drying or based on a predetermined final humidity of air exhausted from the chamber during the drying cycle.

18 Claims, 5 Drawing Sheets

AUTOMATIC DRYING CYCLE AFTER EXECUTION OF SELF CLEAN CYCLE IN A LAUNDRY APPLIANCE

FIELD OF THE INVENTION

The present subject matter relates generally to drying cycles in laundry appliances, or more specifically, to the implementation of drying cycles in response to completion of a self-clean cycle in laundry appliances.

BACKGROUND OF THE INVENTION

Washing machine appliances generally include a tub for containing water or wash fluid, e.g., water and detergent, bleach, and/or other wash additives. A drum is rotatably mounted within the tub and defines a wash chamber for receipt of articles for washing. During normal operation of such washing machine appliances, the wash fluid is directed into the tub and onto articles within the wash chamber of the drum. The drum or an agitation element can rotate at various speeds to agitate articles within the wash chamber, to wring wash fluid from articles within the wash chamber, etc. During a spin or drain cycle of a washing machine appliance, a drain pump assembly may operate to discharge water from within sump.

Notably, when the wash or rinse cycle is completed, excess wash fluid commonly collects in a bottom of the tub, within the door gasket, on internal surfaces, etc. Because the wash tub is partially or substantially sealed, this wash fluid remains in the tub until the next wash or rinse cycle and the humidity remains relatively constant between cycles. Such collected wash fluid, excessive humidity, and moisture may contribute to mold, mildew, or foul smells.

In order to eliminate these issues, conventional appliances include preprogrammed self-clean cycles that are performed to clean the various surfaces and components of the appliance. While self-clean cycles operate to clean residue from the tub, moisture remains even following the self-clean cycle. Users often leave the appliance door open in an effort to promote drying. Some conventional dryers even include the option to run a drying cycle, but such option is frequently not initiated after completion of a self-clean cycle, e.g., because the user forgets to initiate such a cycle or because the self-clean cycle is lengthy compared to a normal wash cycle and is often run overnight.

Accordingly, a laundry appliance including features and operating methods for initiating a drying cycle after completion of a self-clean cycle would be desirable. More specifically, a method for initiating a drying cycle after completion of a self-clean cycle at desirable times and without user intervention would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a laundry appliance is provided including a cabinet, a drum rotatably mounted within the cabinet and defining a chamber configured for receiving a load of clothes, a door pivotally mounted to the cabinet for providing selective access to the chamber, a user interface for controlling operation of the appliance, and a controller operably coupled to the user interface. The controller may be configured to commence a self-clean cycle based on input from the user interface, receive a signal indicating completion of the self-clean cycle, commence a drying cycle based on the signal indicating completion of the self-clean cycle, and execute the drying cycle based on operational data associated with drying cycle.

In another exemplary embodiment, a method of operating a laundry appliance is provided. The laundry appliance includes a drum rotatably mounted within a cabinet and defining a chamber and a user interface. The method includes commencing a self-clean cycle based on input from the user interface, receiving a signal indicating completion of the self-clean cycle, commencing a drying cycle based on the signal indicating completion of the self-clean cycle, and executing the drying cycle based on operational data associated with drying cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
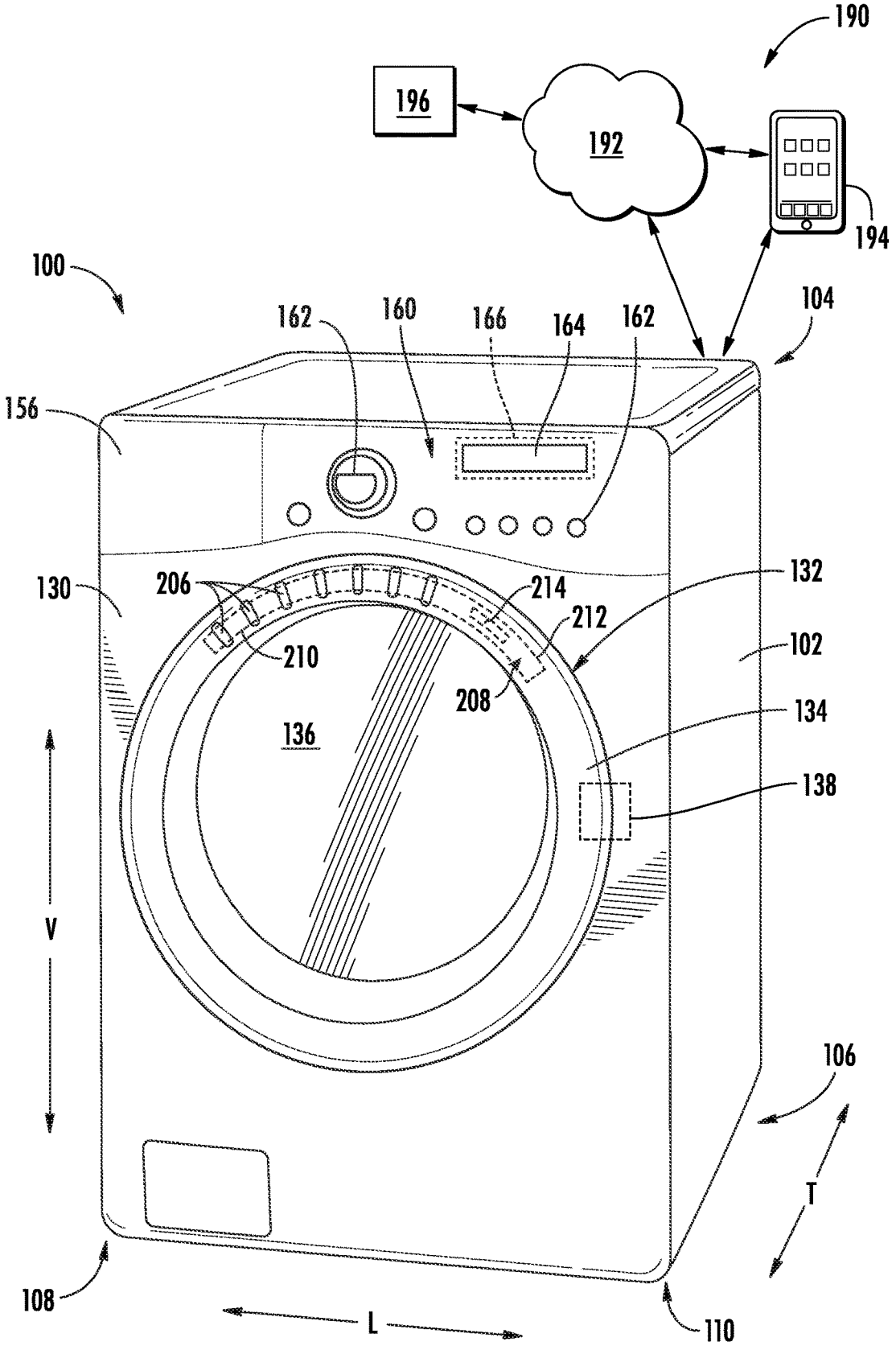
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
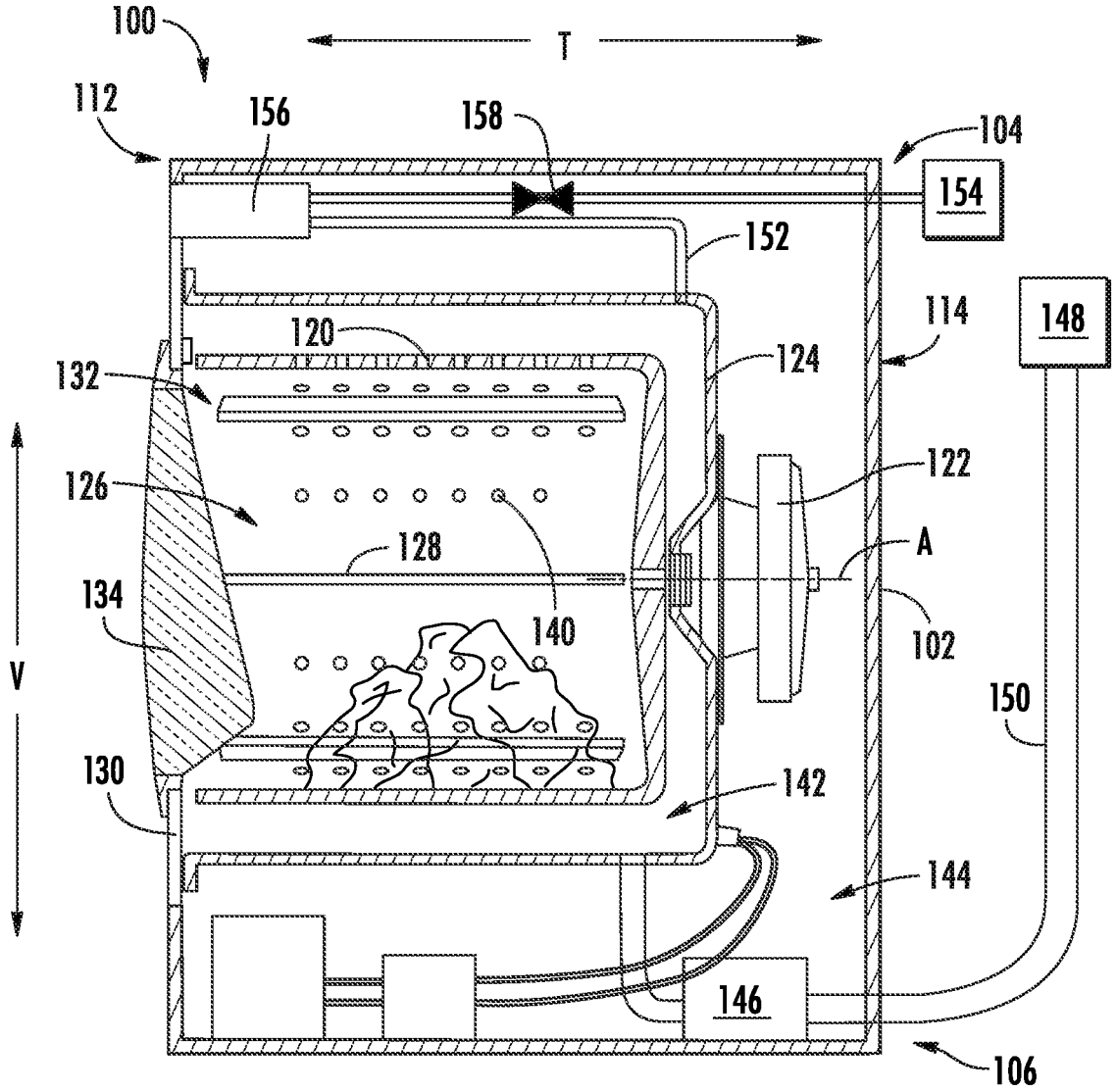
FIG. 2 provides a side cross-sectional view of the exemplary washing machine appliance of FIG. 1.

Referring now to the figures, an exemplary laundry appliance that may be used to implement aspects of the present subject matter will be described. Specifically, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T (FIG. 2).

Referring to FIG. 2, a drum 120 is rotatably mounted within cabinet 102 such that it is rotatable about an axis of rotation A. A motor 122, e.g., such as a pancake motor, is in mechanical communication with drum 120 to selectively rotate drum 120 (e.g., during an agitation or a rinse cycle of washing machine appliance 100). Drum 120 is received within a wash tub 124 and defines a wash chamber 126 that is configured for receipt of articles for washing. The wash tub 124 holds wash and rinse fluids for agitation in drum 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Drum 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in drum 120 during rotation of drum 120.

Referring generally to FIGS. 1 and 2, cabinet 102 also includes a front panel 130 which defines an opening 132 that permits user access to drum 120 of wash tub 124. More specifically, washing machine appliance 100 includes a door 134 that is positioned over opening 132 and is rotatably mounted to front panel 130. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of drum 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Washing machine appliance 100 may further include a latch assembly 138 (see FIG. 1) that is mounted to cabinet 102 and/or door 134 for selectively locking door 134 in the closed position and/or confirming that the door is in the closed position. Latch assembly 138 may be desirable, for example, to ensure only secured access to wash chamber 126 or to otherwise ensure and verify that door 134 is closed during certain operating cycles or events.

Referring again to FIG. 2, drum 120 also defines a plurality of perforations 140 in order to facilitate fluid communication between an interior of drum 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from drum 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout 152 is configured for directing a flow of fluid into wash tub 124. For example, spout 152 may be in fluid communication with a water supply 154 (FIG. 2) in order to direct fluid (e.g., clean water or wash fluid) into wash tub 124. Spout 152 may also be in fluid communication with the sump 142. For example, pump assembly 144 may direct wash fluid disposed in sump 142 to spout 152 in order to circulate wash fluid in wash tub 124.

As illustrated in FIG. 2, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to spout 152 to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

Referring again to FIG. 1, control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users. Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into drum 120 through opening 132, and washing operation is initiated through operator manipulation of input selectors 162. Wash tub 124 is filled with water, detergent, and/or other fluid additives, e.g., via spout 152 and/or detergent drawer 156. One or more valves (e.g., water supply valve 158) can be controlled by washing machine appliance 100 to provide for filling drum 120 to the appropriate level for the amount of articles being washed and/or rinsed. By way of example for a wash mode, once drum 120 is properly filled with fluid, the contents of drum 120 can be agitated (e.g., with ribs 128) for washing of laundry items in drum 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within drum 120. One or more spin cycles may also be used. In particular, a spin cycle may be applied after the wash cycle and/or after the rinse cycle in order to wring wash fluid from the articles being washed. During a final spin cycle, drum 120 is rotated at relatively high speeds and drain assembly 144 may discharge wash fluid from sump 142. After articles disposed in drum 120 are cleaned, washed, and/or rinsed, the user can remove the articles from drum 120, e.g., by opening door 134 and reaching into drum 120 through opening 132.

Notably, controller 166 of washing machine appliance 100 (or any other suitable dedicated controller) may be communicatively coupled to control panel 160 and input selectors 162, and other components of washing machine appliance 100, such as fan 204 and humidity sensor 202, as described below. As explained in more detail below, controller 166 may be programmed or configured for automating elements of the washing machine appliance 100 at particular times as part of particular cycles, e.g., such as initiating an automated drying cycle upon completion of a self-cleaning cycle with little or no user intervention.

Referring still to FIG. 1, a schematic diagram of an external communication system 190 will be described according to an exemplary embodiment of the present subject matter. In general, external communication system 190 is configured for permitting interaction, data transfer, and other communications with washing machine appliance 100. For example, this communication may be used to provide and receive operating parameters, cycle settings, performance characteristics, user preferences, user notifications, or any other suitable information for improved performance of washing machine appliance 100.

External communication system 190 permits controller 166 of washing machine appliance 100 to communicate with external devices either directly or through a network 192. For example, a consumer may use a consumer device 194 to communicate directly with washing machine appliance 100. For example, consumer devices 194 may be in direct or indirect communication with washing machine appliance 100, e.g., directly through a local area network (LAN), Wi-Fi, Bluetooth, Zigbee, etc. or indirectly through network 192. In general, consumer device 194 may be any suitable device for providing and/or receiving communications or commands from a user. In this regard, consumer device 194 may include, for example, a personal phone, a tablet, a laptop computer, or another mobile device.

In addition, a remote server 196 may be in communication with washing machine appliance 100 and/or consumer device 194 through network 192. In this regard, for example, remote server 196 may be a cloud-based server 196, and is thus located at a distant location, such as in a separate state, country, etc. In general, communication between the remote server 196 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 192 can be any type of communication network. For example, network 192 can include one or more of a wireless network, a wired network, a personal area network, a local area network, a wide area network, the internet, a cellular network, etc. According to an exemplary embodiment, consumer device 194 may communicate with a remote server 196 over network 192, such as the internet, to provide user inputs, transfer operating parameters or performance characteristics, receive user notifications or instructions, etc. In addition, consumer device 194 and remote server 196 may communicate with washing machine appliance 100 to communicate similar information.

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more laundry appliances, other communication protocols and steps may be implemented, etc.

These variations and modifications are contemplated as within the scope of the present subject matter.

Referring again to the embodiment of FIG. 1, door 134 may further include air intake openings 206. Air intake openings 206 may be one or more openings in door 134 that permit air to pass between the outside and the inside of wash tub 124. To enable this function, air intake openings 206 may be located on both the interior and exterior surfaces of door 134. In some embodiments, air intake openings 206 may constitute numerous small, individual openings. In alternative embodiments, air intake openings 206 may constitute only a single opening. The surface area of the air intake openings 206 (or the combined surface area in the case of multiple air intake openings 206) may be varied to control, in part, the flow of air between the exterior and interior of the tub. In some embodiments, it may be desirable to include a screen or other filter (not pictured) over the air intake openings to discourage the passage of lint or other solids from entering the wash tub 124. Although air intake openings 206 are located in door 134 in the embodiment of FIG. 1, it will be recognized that air intake openings 206 may be located elsewhere on washing machine appliance 100 in alternative embodiments. Indeed, air intake openings 206 may be located anywhere that would allow passage of air between the inside and the outside of wash tub 124, such as on a surface of cabinet 130.

As shown in FIG. 1, washing machine appliance 100 may further include a damper 208. In the embodiment of FIG. 1, damper 208 may include a first end 210 and a second end 212. A damper opening 214 may be located at the second end 212 of damper 208. Damper 208 may be movable between an open and closed position, wherein the open position is characterized by alignment of damper opening 214 with air intake openings 206 and the closed position is characterized by alignment of the first end 210 of damper 208 with air intake openings 206. When in the closed position, damper 208 blocks the passage of air between the inside and the outside of wash tub 124. Conversely, in the open position, damper 208 permits such air flow. Although a particular embodiment of damper 208 is provided in FIG. 1, it will be recognized that other embodiments for selectively permitting air flow into the wash tub 124 through air intake openings 206 fall within the scope of the present disclosure. For example, in some embodiments, damper 208 may lack a damper opening 214 altogether. In such an embodiment, the open position of damper 208 is characterized by no portion of damper 208 being position in alignment with air intake openings 206. In still other embodiments, damper opening 214 may consist of a plurality of openings corresponding to the plurality air intake openings 206. In such embodiment, opening or closing of damper 208 need not involve movement from a first end 210 to a second end 212 (or vice versa), but rather shifting of the alignment of the plurality of damper openings 214 with the plurality of air intake openings 206. In still other embodiments, damper 208 may consist of a series of planar elements aligned with the air intake openings 206 that individually rotate about a vertical axis, the rotation resulting in covering and uncovering the air intake openings 206. Those of ordinary skill will recognize that other embodiments of a moving damper that selectively allow air flow through the air intake openings 206 are intended to fall within the scope of the present disclosure.

Figure 3:
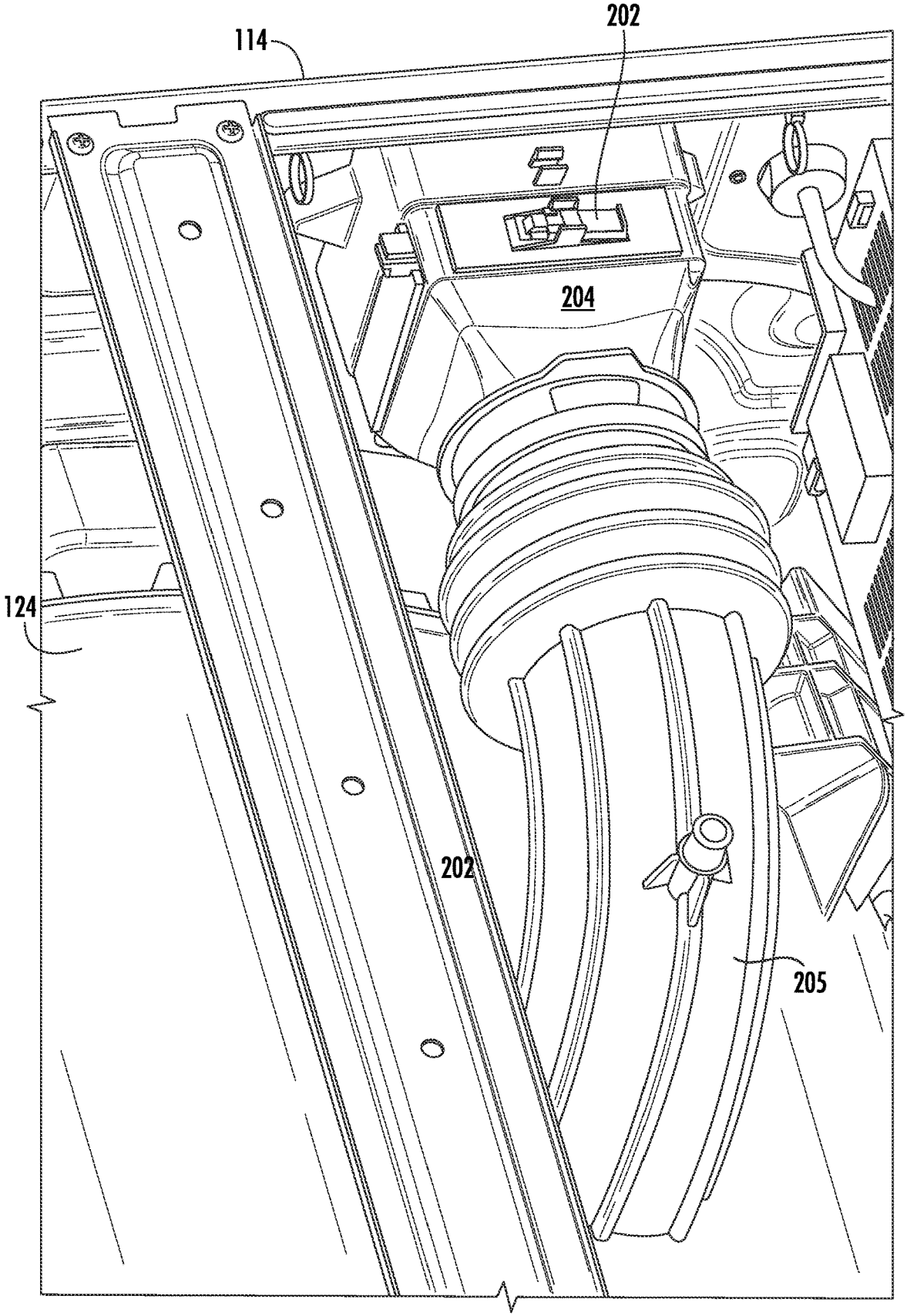
FIG. 3 provides a perspective view of a fan and humidity sensor within a washing machine appliance according to an exemplary embodiment of the present subject matter.

Referring now to FIG. 3, washing machine appliance 100 further includes a fan 204. Fan 204 may be position on the rear 114 of cabinet 102. Fan 204 may be attached to a conduit 205. Conduit 205 may be further attached to wash tub 204. Fan 204 operates by drawing air out of wash tub 204, through conduit 205, and exhausting the air from washing machine appliance 100. Washing machine appliance may further include a humidity sensor 202 for measuring the humidity of the air being exhausted from wash tub 124. As shown in FIG. 3, fan 204 is situated along the rear 114 of cabinet 102 and humidity sensor 202 is situated in close proximity to fan 204. However, in alternative embodiments, fan 204 and humidity sensor 202 may be located in alternative locations, so long as fan 204 serves to draw air from wash tub 124 and exhaust it from washing machine appliance 100, and humidity sensor 204 is positioned to read the humidity level of this exhausted air.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., a combination washer/dryer appliance. Indeed, it should be appreciated that aspects of the present subject matter may further apply to other laundry appliances, such a dryer appliance. In this regard, the same methods and systems as described herein may be used to initiate and terminate drying cycles under certain circumstances in other appliances, such as a dryer appliance.

Figure 4:
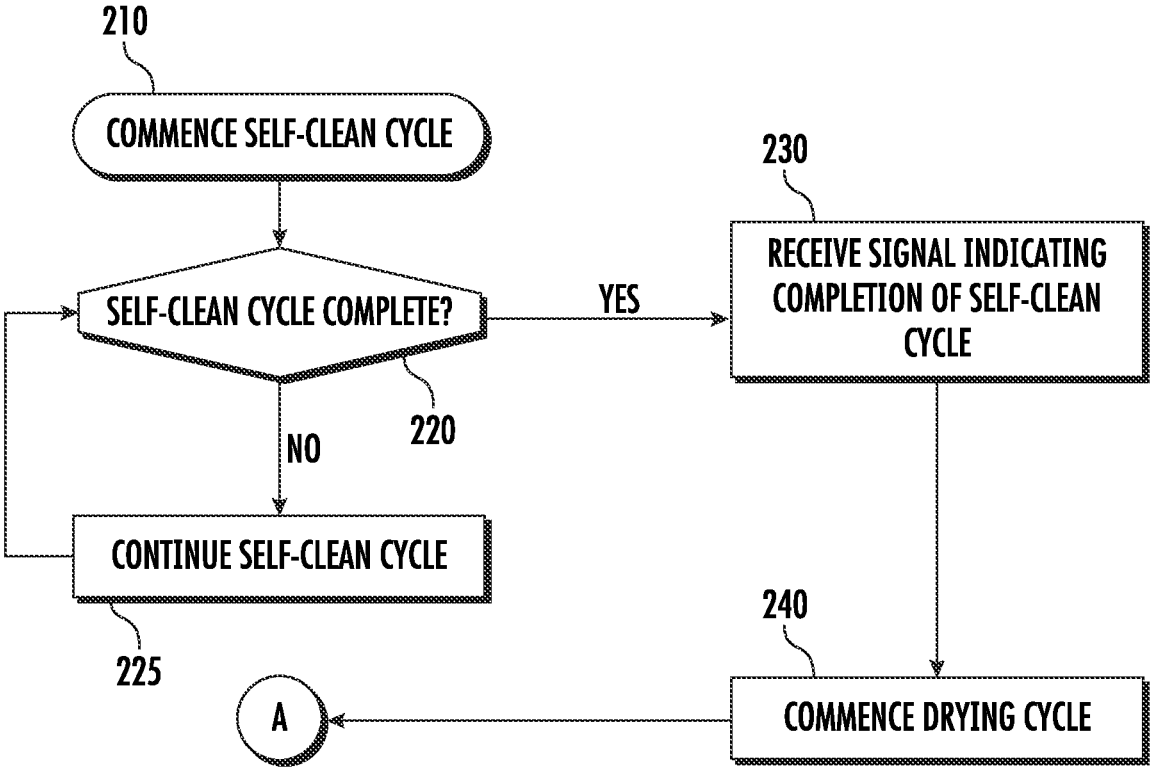
FIG. 4 provides a flow diagram illustrating a portion of an exemplary process for implementing an automated drying cycle in response to completion of a self-clean cycle according to an exemplary embodiment of the present subject matter.
Figure 5:
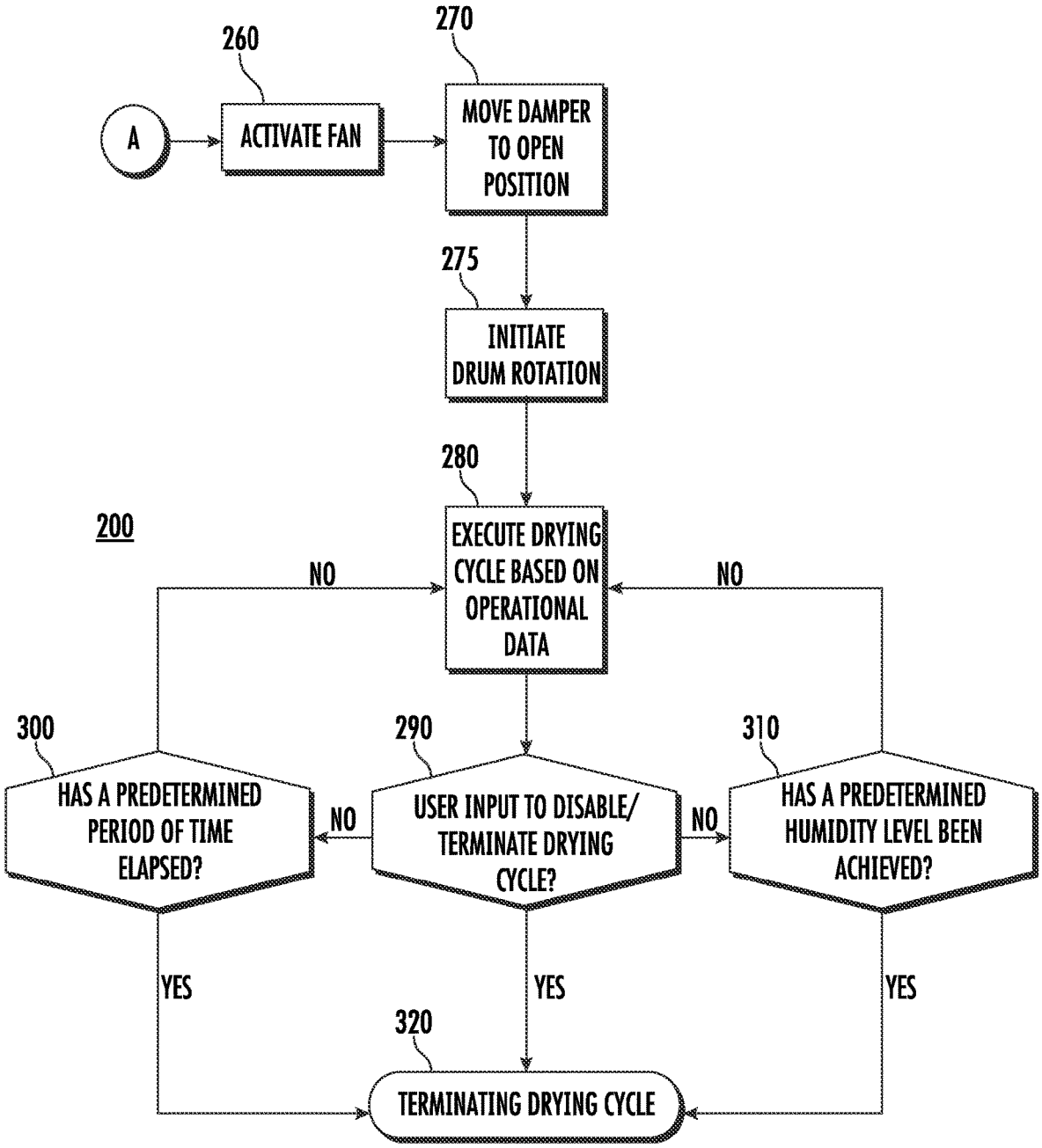
FIG. 5 provides a flow diagram illustrating a portion of an exemplary process for implementing an automated drying cycle in response to completion of a self-clean cycle according to an exemplary embodiment of the present subject matter.

Now that the construction of washing machine appliance 100 and the configuration of controller 166 according to exemplary embodiments have been presented, an exemplary method 200 of operating a washing machine appliance will be described. Referring now to FIGS. 4 and 5, method 200 includes, at step 210, commencing a self-clean cycle based on receipt of an input from the user interface. A self-clean cycle is a washing machine cycle option that is typically run without any articles for washing in the wash chamber. It generally involves filling the wash tub with water to soak the crevices within the tub and loosen any accumulated dirt or other debris. The self-clean cycles follows this soaking stages by rotating the drum at high speed to dislodge any dirt and debris and rinse it away. For front-load washers, a self-clean cycle may be lengthy (e.g., 4-8 hours) and, as a result, users often elect to run self-clean cycles overnight.

At step 220, method 200 determines whether the self-clean cycle is complete (e.g., whether an elapsed period of time has expired). If not, the self-clean cycle continues at step 225. Once it is determined that the self-clean cycle is complete at step 220, a signal indicating completion of the self-clean cycle is received at step 230. Method 200 then proceeds to step 240, wherein a drying cycle is automatically commenced in response to receiving the signal indicating completion of the self-clean cycle. Like the self-clean cycle, a drying cycle typically proceeds with the absence of any articles for washing in the washing chamber. The drying cycle involves the passing air through the wash tub to remove moisture in the wash tub, and particularly in any crevices therein.

Upon commencing the drying cycle, method 200 activates fan 204 at step 260, drawing air from the wash tub and exhausting it from the washing machine. Additionally, at step 270, damper 208 is moved to an open position. This provides an additional source of air, allowing for an increased air flow through the wash tub. Further, method 200 additionally initiates rotation of drum 120 at step 275. As previously noted, rotation of drum 120 at high speed during some or all portions of the drying cycle may assist in speeding the rate of drying during the drying cycle. Rotation of drum 120 may be in the clockwise, counterclockwise, or may alternate between clockwise and counterclockwise rotation. At step 280, method 200 executes the drying cycle based on operational data associated with drying cycle, as further described herein. Moreover, it will be recognized that, although initiation of rotation of drum 120 occurs at the beginning of the drying cycle in the preferred embodiment, this is not a requirement. Rotation of drum 120 may occur throughout the drying cycle in some embodiments. In other embodiments rotation of drum 120 may be intermittent, rotating during one or more portions of the drying cycle and not rotating during other portions of the drying cycle. In other embodiments, rotation of drum 120 may be delayed for a predetermined period of time after initiation of the drying cycle. As such, the skilled artisan will recognize that variations in the timing and quantity of initiations of rotation of drum 120 after commencing the drying cycle are all intended to fall within the scope of the present disclosure.

Method 200 permits a user to terminate the drying cycle at any point that the drying cycle remains active. Thus, at step 290, it is determined whether the drying cycle should be interrupted based on an input from the user interface, for example, pressing of a self-clean button on the user interface. In alternative embodiments, input from the user interface may include receipt of a signal relayed from a mobile device directly to the washing machine appliance (e.g., through a LAN) or indirectly through an external server. Interruption of the drying cycle may include termination of the ongoing drying cycle alone. Alternatively, or additionally, interruption of the drying cycle may include disabling of the automated running of a drying cycle for subsequent cycles, such as disabling the drying cycle based on the signal indicating completion of the self-clean cycles for future self-clean cycles. In the event that it is determined that no such interruption is requested, method 200 continues with the drying cycle.

As previously noted at step 280, execution of the drying cycle is based on operational data. In some embodiments, operational data may include a predetermined period of time after which the drying cycle is complete (e.g., 1 hour). In other embodiments, the operational data may include a predetermined humidity level of the air at which the drying cycle is complete. In this embodiment, a humidity sensor may measure the humidity of the air exhausted from the wash tub during the drying cycle and compare the measured humidity against the predetermined desirable humidity. In some cases, the predetermined humidity may be the humidity of the ambient air outside the washing machine appliance. In that instance, the equalization of the humidity of the ambient air and the humidity of the air exhausted from the wash chamber is indicative that the drying cycle has removed excess moisture from the wash chamber. Because humidity levels of the ambient air may vary based on weather, geographic climate, and a wide variety of other conditions relating to the washing machine appliance, the predetermined humidity level may be based on a measurement using the humidity sensor or other sensor prior to operation of the drying cycle.

The operational data associated with a drying cycle may also be a combination of these factors, as shown in the embodiment of method 200 shown in FIG. 5, or other factors that will be apparent to the skilled artisan. As seen in FIG. 5, in the absence of a user input interrupting the drying cycle, method 200 further includes determining whether a predetermined period of time has elapsed since execution of the drying cycle at step 300. If the predetermined period of time has not expired, the method 200 reverts to step 280 and continues executing the drying cycle based on the operational data. Similarly, method 200 further includes determining whether the air being exhausted from the washing tub has reached the predetermined humidity. If not, the method 200 reverts to step 280 and continues executing the drying cycle based on the operational data.

At step 320, the drying cycle is terminated. This step may be reached in several ways. First, if it is determined at step 300 that the predetermine period of time for the drying cycle has elapsed, the drying cycle is terminated at step 320. Similarly, if it is determined at step 310 that the air exhausted from the washing tub has reached the predetermined humidity, the drying cycle is also terminated at step 320. Further, if user input from the user interface indicates an intent to interrupt the drying cycle, the drying cycle is again terminated at step 320.

FIGS. 4-5 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using washing machine appliance 100 as an example, it should be appreciated that these methods may be applied to the operation of any suitable washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a laundry appliance, the laundry appliance comprising a drum rotatably mounted within a cabinet and defining a chamber, and a user interface, the method comprising:

commencing a self-clean cycle based on input from the user interface;

receiving a signal indicating completion of the self-clean cycle;

commencing a drying cycle based on the signal indicating completion of the self-clean cycle; and executing the drying cycle based on operational data associated with drying cycle;

receiving an input from the user interface indicating the disabling of the drying cycle from automatically executing upon the completion of one or more future self-clean cycles, wherein a drying cycle does not automatically commence upon receiving a signal indicating completion of one or more future self-clean cycles.

2. The method of claim 1, wherein the operational data associated with the drying cycle is a predetermined period of time after which the drying cycle is complete.

3. The method of claim 1, wherein the laundry appliance further comprises a humidity sensor and wherein the operational data associated with the drying cycle is a predetermined humidity at which the drying cycle is complete.

4. The method of claim 3, wherein the predetermined humidity is the humidity of the ambient air.

5. The method of claim 4, wherein the method further comprises measuring the humidity of the ambient air outside the laundry appliance using the humidity sensor prior to commencing the self-clean cycle to determine the predetermined humidity.

6. The method of claim 3, wherein the humidity sensor is positioned to read the humidity of air exhausted from the chamber.

7. The method of claim 1, wherein the laundry appliance further comprises a fan for circulating air through the drum and wherein commencing the drying cycle further includes activating the fan and initiating rotation of the drum.

8. The method of claim 1, wherein the laundry appliance further comprises a damper movable between a closed position and an open position, and wherein commencing the drying cycle further includes moving the damper to an open position.

9. The method of claim 1, wherein the method further comprises interrupting the drying cycle based on input from the user interface.

10. A method of operating a laundry appliance, the laundry appliance comprising a drum rotatably mounted within a cabinet and defining a chamber, a user interface, a damper having a plurality of openings, and a plurality of air intake openings, the method comprising:

commencing a self-clean cycle based on input from the user interface;

receiving a signal indicating completion of the self-clean cycle;

commencing a drying cycle based on the signal indicating completion of the self-clean cycle;

moving the damper from a closed position in which the plurality of openings of the damper do not align with the plurality of air intake openings to an open position in which the plurality of the damper do align with the plurality of air intake openings;

executing the drying cycle based on operational data associated with drying cycle and receiving an input from the user interface indicating the disabling of the drying cycle from automatically executing upon the completion of one or more future self-clean cycles, wherein a drying cycle does not automatically commence upon receiving a signal indicating completion of one or more future self-clean cycles.

11. The method of claim 10, wherein the operational data associated with the drying cycle is a predetermined period of time after which the drying cycle is complete.

12. The method of claim 10, wherein the laundry appliance further comprises a humidity sensor and wherein the operational data associated with the drying cycle is a predetermined humidity at which the drying cycle is complete.

13. The method of claim 12, wherein the predetermined humidity is the humidity of the ambient air.

14. The method of claim 12, wherein the humidity sensor is positioned to read the humidity of air exhausted from the chamber.

15. The method of claim 14, wherein the method further comprises measuring the humidity of the ambient air outside the laundry appliance using the humidity sensor prior to commencing the self-clean cycle to determine the predetermined humidity.

16. The method of claim 10, wherein the laundry appliance further comprises a fan for circulating air through the drum and wherein commencing the drying cycle further includes activating the fan and initiating rotation of the drum.

17. The method of claim 10, wherein the laundry appliance further comprises a damper movable between a closed position and an open position, and wherein commencing the drying cycle further includes moving the damper to an open position.

18. The method of claim 10, wherein the method further comprises interrupting the drying cycle based on input from the user interface.

* * * * *